US005743717A

United States Patent [19]

Schmidt

[11] Patent Number: 5,743,717

[45] Date of Patent: Apr. 28, 1998

[54] NOZZLE-VENTURI GAS LIFT FLOW CONTROL DEVICE

[75] Inventor: Zelimir Schmidt, Tulsa, Okla.

[73] Assignee: Fluid Flow Engineering Company, Tulsa, Okla.

[21] Appl. No.: 917,879

[22] Filed: Aug. 27, 1997

Related U.S. Application Data

[63] Continuation of Ser. No. 725,219, Sep. 27, 1996, abandoned, which is a continuation of Ser. No. 466,691, Jun. 6, 1995, abandoned, which is a continuation of Ser. No. 301,661, Sep. 7, 1994, abandoned, which is a continuation-in-part of Ser. No. 269,888, Jul. 1, 1994, abandoned.

[51] Int. Cl.[6] ..... F04F 1/18; F04F 1/20

[52] U.S. Cl. ..... 417/109; 417/108; 417/198; 137/155; 166/372; 166/374

[58] Field of Search ..... 417/108, 109, 417/110, 111, 115, 116, 117, 178, 198, 54; 137/155; 166/320, 372, 374

[56] References Cited

U.S. PATENT DOCUMENTS

| | | | |
|---|---|---|---|
| 233,499 | 10/1880 | Frizeil | 417/108 |
| 814,601 | 3/1906 | Harris | 417/109 |
| 1,602,190 | 10/1926 | Eddy et al. | 166/372 |
| 1,856,872 | 5/1932 | Kogan | 417/109 |
| 2,008,172 | 7/1935 | Bryant | 417/115 |
| 2,323,893 | 7/1943 | Boynton | 137/155 |
| 2,716,509 | 8/1955 | Saul | 417/108 |
| 2,717,648 | 9/1955 | Baker | 166/320 |
| 3,324,803 | 6/1967 | Kelley et al. | 137/155 |
| 3,523,744 | 8/1970 | Holladay, Jr. | 417/115 |
| 3,672,790 | 6/1972 | White et al. | 417/108 |
| 3,784,325 | 1/1974 | Coanda et al. | 417/170 |
| 3,884,299 | 5/1975 | McCarter et al. | 417/109 |
| 4,087,207 | 5/1978 | Chappel et al. | 417/54 |
| 4,111,608 | 9/1978 | Elliott et al. | 417/112 |
| 4,251,191 | 2/1981 | Gass et al. | 417/111 |
| 4,397,612 | 8/1983 | Kalina | 417/109 |

(List continued on next page.)

OTHER PUBLICATIONS

Gas Lift Valves—Teledyre Merla, 5/1983, pp. 8–9 classified 417/109.

Moran and Shapiro—Fundamentals of Engineering Thermodynamics, 1988, pp. 414–415, Figure 9.30.

Grupping, A.W.; Luca, C.W.F.; Vermeulen, F.D., "Heading Action Analyzed for Stabilization", *Oil & Gas Journal*, Jul. 23, 1984, pp. 47–51.

Grupping, A.W.; Luca, C.W.F.; Vermeulen, F.D., "These Methods Can Eliminate or Control Annulus Heading", *Oil & Gas Journal*, Jul. 30, 1984, pp. 186–191.

Torre, A.J.; Schmidt, Z.; Blais, R.N.; Doty, D.R.; Brill, J.P., "Casing Heading in Flowing Oil Wells", SPE *Production Engineering*, Nov. 1987, pp. 297–303.

Asheim, H., "Criteria for Gas-Lift Stability", *Journal of Petroleum Technology*, Nov. 1988, pp. 1452–1456.

Alhanati, F.J.S.; Schmidt, Z.; Doty, D.R., "Continuous Gas-Lift Instability: Diagnosis, Criteria, and Solutions", Paper SPE 26554 presented at the 68th Annual Technical Conference and Exhibition of the Society of Petroleum Engineers, Houston, Texas Oct. 3–6, 1993, pp. 401–416.

Everitt, T.A., "Gas-Lift Optimization in a Large, Mature GOM Field", Paper SPE 28466 presented at the 69th Annual Technical Conference and Exhibition of the Society of Petroleum Engineers, New Orleans, LA, Sep. 25–28, 1994, pp. 25–33.

Clegg, J.D.; Gault, R.; Lea, J.; Winkler, H., "Specialists Share Experience With Artifical-Lift Methods", *Journal of Petroleum Technology*, May 1995, pp. 364–393.

*Primary Examiner*—Timothy Thorpe
*Assistant Examiner*—Ted Kim Tu
*Attorney, Agent, or Firm*—Martin Korn

[57] ABSTRACT

A gas flow control device for injecting gas into a production string for recovering pressure and reducing frictional losses, so that critical flow can be reached at lower pressure drops and higher production pressure, includes a nozzle having first and second ends, and a flow path therebetween, and a Venturi having first and second ends, and a flow path therebetween. The first end of the Venturi is disposed adjacent to the second end of the nozzle. The Venturi flow path is aligned with the nozzle flow path to provide a continuous flow path through the valve.

18 Claims, 2 Drawing Sheets

U.S. PATENT DOCUMENTS

| | | | |
|---|---|---|---|
| 4,441,861 | 4/1984 | Canalizo | 417/54 |
| 4,573,877 | 3/1986 | Baumberg | 417/198 |
| 4,603,735 | 8/1986 | Black | 166/372 |
| 4,792,284 | 12/1988 | Straub | 417/198 |
| 5,066,198 | 11/1991 | Decker | 417/54 |
| 5,107,441 | 4/1992 | Decker | 137/155 |

NOZZLE-VENTURI GAS LIFT FLOW CONTROL DEVICE

RELATED APPLICATION

This application is a continuation of application Ser. No. 08/725,219, filed Sep. 27, 1996, abandoned entitled "Nozzle-Venturi Gas Lift Flow Control Device" abandoned which is a continuation of Ser. No. 08/466,691, filed Jun. 6, 1995, abandoned entitled "Nozzle-Venturi Gas Lift Flow Control Device", abandoned, which is a continuation of application Ser. No. 08/301,661, filed Sep. 7, 1994, entitled "Nozzle-Venturi Gas Lift Flow Control Device", abandoned, which is a continuation-in-part of application Ser. No. 08/269,888, filed Jul. 1, 1994, entitled "Nozzle-Venturi Gas Lift Valve", abandoned.

TECHNICAL FIELD OF THE INVENTION

The present invention relates to gas lift valves for injecting gas into the production string of a gas lift well, and more particularly to a nozzle-Venturi gas lift flow control device.

BACKGROUND OF THE INVENTION

In pumping oil from a geological formation, natural pressure is employed to lift fluent oil upwardly to the ground surface. This pressure can abate over time, requiring steps to improve lift. One commonly known method of augmenting lift is to inject gas into the production string. This injection is usually done by forcing gas down the annulus between the production tubing which conducts oil to the surface, and the steel casing of the well. The gas is constrained to flow through a gas flow control device into the production tubing. The gas bubbles mix with the oil, thus reducing the overall density of the mixture, and lift is improved.

There are two types of gas flow control devices commonly employed to control the injected gas into the production tubing, gas lift valves and orifices. Gas lift valves are generally considered less desirable, because of expense and because their construction obstructs gas flow. An orifice overcomes both objections, and is therefore more frequently employed in oil fields.

A common problem in continuous gas lift is flow instability characterized by large flow rate and pressure fluctuations that can cause severe separation and injection gas distribution problems. Gas lift instability is associated with low productivity wells that have a large annulus and/or produce at low gas injection rates. In addition, gas lift instability can occur if the flow through a gas flow control device is in the subcritical flow regime. In the critical or sonic flow regime, the production pressure does not affect the gas flow rate through the device and flow instability cannot occur. However, the gas flow control device is often not used in the critical or sonic flow regime since a large pressure differential across the device is required and such a large pressure differential is usually not available.

Counteracting measures may be taken to avoid flow instabilities. These measures include increasing the gas injection rate, and choking production at the wellhead. Increased rates cause gas injection to be performed above the most economical rate, and choking reduces rate of production. Thus, there are economical objections to the usual measures for coping with gas lift instability. These steps are the usual industry response to the problem. A need thus exists for a structure for altering flow characteristics in a gas lift gas flow control device that eliminates or minimizes flow instability.

SUMMARY OF THE INVENTION

In accordance with the present invention, a gas flow control device for injecting gas into a production string for recovering gas pressure and reducing frictional losses, so that critical flow can be reached at lower pressure drops and thus higher production pressure is provided. The device includes a nozzle having first and second ends, and a flow path therebetween. A Venturi is provided. The Venturi includes first and second ends, and a flow path therebetween. The first end of the Venturi is disposed adjacent to the second end of the nozzle. The Venturi flow path is aligned with the nozzle flow path to provide a continuous flow path through the device.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
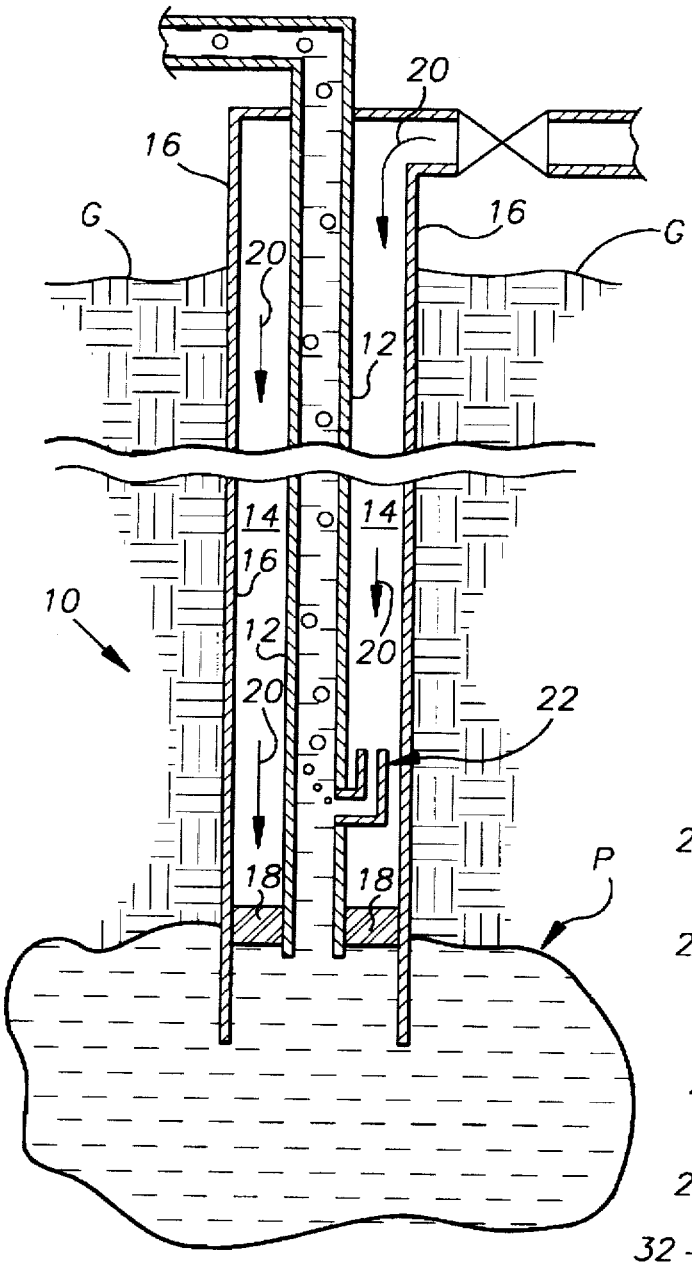
FIG. 1 is a cross-sectional, side-elevational, diagrammatic view of the environment of a gas injection control device.

The present invention is employed in an environment shown in FIG. 1. A gas lift well system 10 extends from above ground G, where system 10 is connected to a pressurized gas source (not shown) and to petroleum recovery equipment (not shown), and a subterranean petroleum reservoir P. Petroleum rises in production tubing 12. Pressurized gas is introduced into annulus 14, which exits between production tubing 12 and outer steel casing 16. Annulus 14 is sealed at the bottom of casing 16 by a packer 18. Pressurized gas, represented by arrows 20, flows from annulus 14 into tubing 12 via a gas flow control device 22. Gas injected into production tubing 12 decreases the density of petroleum rising to the surface and enables natural pressure to maintain this flow.

Figure 2:
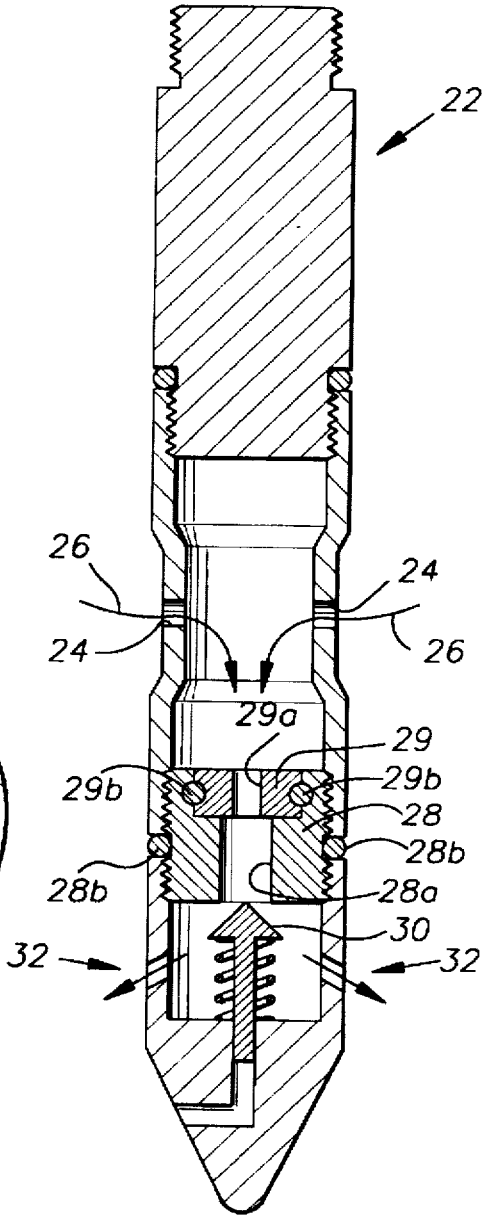
FIG. 2 PRIOR ART
FIG. 2 is a cross-sectional view of a standard orifice gas injection control device.

Gas flow control device 22 is illustrated in FIG. 2. Pressurized gas at injection pressure enters device 22 through inlets 24, gas flow direction being indicated by arrows 26, and flows through a square-edge orifice 29, containing passage **29*a* and seal 29*b*. Gas then passes through passageway 28*a* of an orifice holder 28 and past the check valve 30. Gas is then discharged through outlet 32, at production pressure, and passes into production tubing 12** (FIG. 1).

Figure 3:
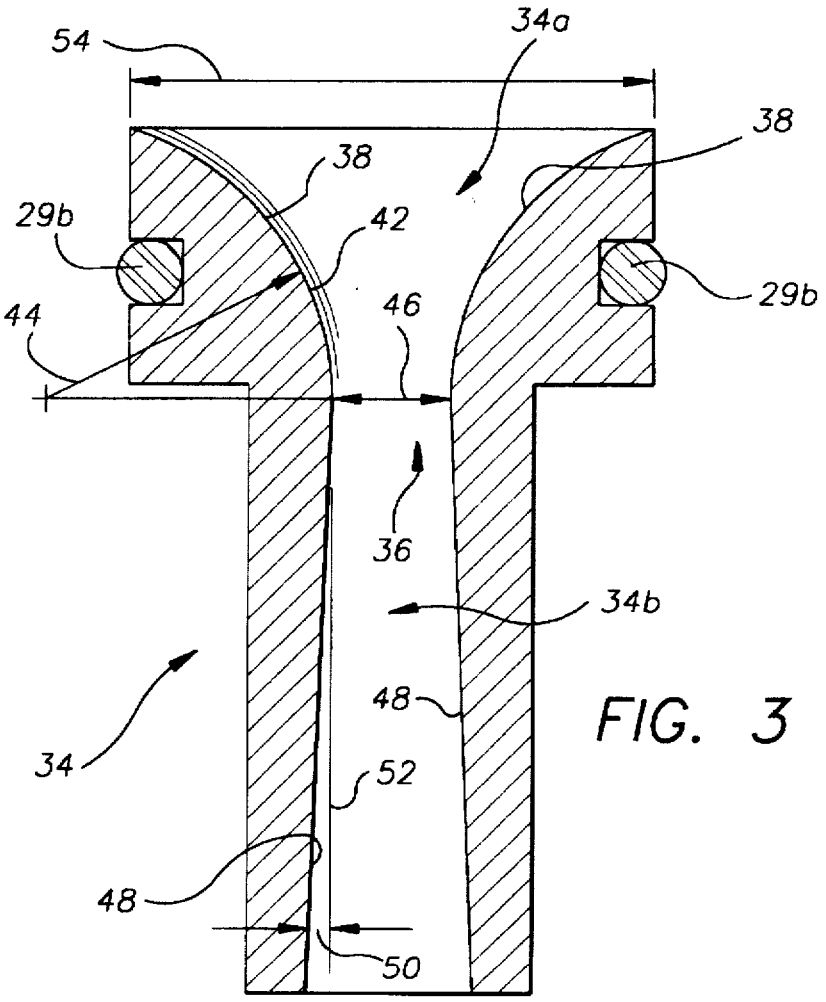
FIG. 3 is a cross-sectional view of the present nozzle-Venturi gas flow control device.

FIG. 3 illustrates the present nozzle-Venturi 34 which replaces the square-edge orifice 29. Nozzle-Venturi 34 may comprise, for example, a circular arc Venturi and includes a nozzle portion **34*a* and a Venturi portion 34*b*. Nozzle portion 34*a* lies above a throat 36, and Venturi portion 34*b* lies below throat 36**.

Nozzle portion **34*a* includes sidewalls 38 which offer minimal resistance to the flow of fluid (gas) as the gas approaches throat 36. Sidewalls 38 are progressively restrictive to throat 36. The cross-sectional area of throat 36 is less than the cross-sectional area of nozzle portion 34***a* and Venturi portion 34*b*.

Sidewalls 38 are curved such that the slopes of tangent lines measured at each point along the curve 42 of nozzle portion 34*a*, slope being considered in the mathematical sense, is greater at tangent points approaching throat 36. Also, curvature of nozzle portion 34*a* is such that there is a radius of curvature 44 which is greater than a diameter 46 of the throat 36 by a factor between 1.5 and 2.5, a preferred value being 1.9.

Below throat 36, Venturi 34*b* increases in cross-section area at a rate such that vertical walls 48 thereof form an angle 50 to a vertical direction 52. Angle 50 lies within a range of four to fifteen degrees, a preferred value being six degrees.

The ratio of the cross-sectional area at the diameter 46 of throat 36 to the cross-sectional area at the widest point of nozzle portion 34*a*, as measured at the mouth 54, is equal to or less than 0.4.

Cross-sections of nozzle-Venturi 34, considering those cross-sections taken along planes perpendicular to the Venturi axis, are generally represented as being circular. This is due to the expectation that manufacturing processes for forming nozzle-Venturi 34, or for forming a die or mold to manufacture the same will be centered around cutting a rotating piece of stock, as exemplified by a lathe operation. However, it is recognized that other manufacturing processes are possible, and that other geometries are thus possible. For example, corresponding cross-sections of nozzle-Venturi 34 may be rectangular or even of other configurations.

Gas flowing within nozzle portion 34*a* of nozzle-Venturi 34 flows at a high velocity and a low pressure. The gas flowing through Venturi portion 34*b* decreases in velocity and increases in pressure such that the gas exiting the valve 22 has pressure recovered with a minimal amount of energy or pressure loss.

Figure 4:
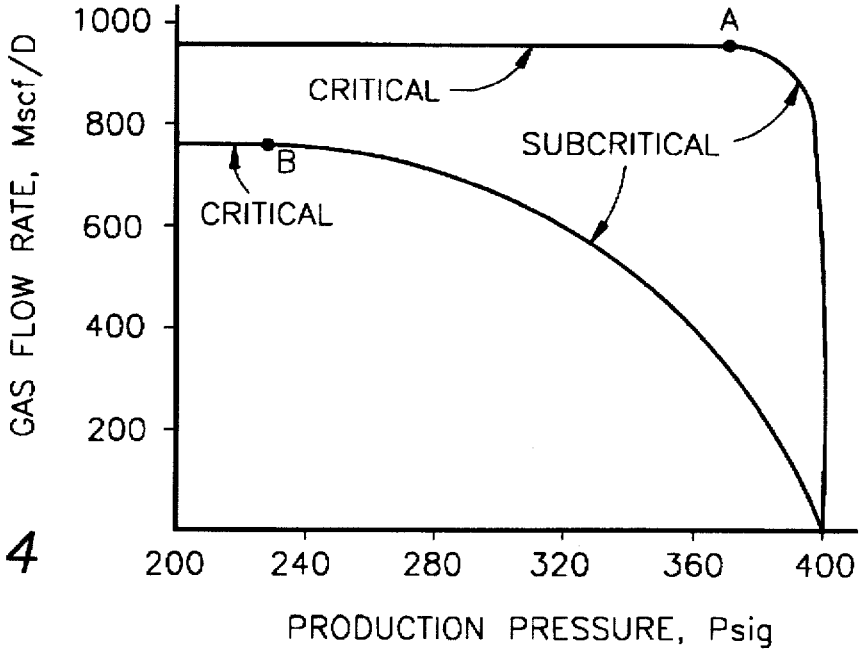
FIG. 4 is a graph comparing dynamic performance of a gas flow control device employing a square-edge orifice shown in FIG. 2 and the nozzle-Venturi of the present invention.

Dynamic performance of an injection gas flow control device having the present nozzle-Venturi 34 is compared to that of a similar injection gas flow control device having a square-edge orifice 29 in FIG. 4. The sonic (critical), flow rate regime is that portion of each curve which is horizontal. By operating a gas injection gas flow control device in the sonic flow regime, a stable gas lift system is achieved. It will be readily appreciated that the broad flat portion between the vertical axis and point A, representing stable performance of the nozzle-Venturi 34, is much wider than the corresponding flat portion between the vertical axis and point B, representing stable performance of a conventional square-edge orifice 29. Moreover, at similar production pressures, more gas flows through nozzle-Venturi 34 than through a square-edge orifice having the same throat size.

The present nozzle-Venturi 34 provides for a lower pressure drop. Square-edge orifices typically require a pressure drop of 46 percent of upstream pressure to produce sonic velocity flow therethrough. The present nozzle-Venturi, by contrast, requires less than a 10 percent pressure drop.

It therefore can be seen that the present nozzle-Venturi provides for a gas flow control device that minimizes well instabilities by extending the critical flow rate regime and by rendering lift operations independent of production pressure.

Whereas the present invention has been described with respect to specific embodiments thereof, it will be understood that various changes and modifications will be suggested to one skilled in the art and it is intended to encompass such changes and modifications as fall within the scope of the appended claims.

I claim:

1. A device for controlling a flow of gas from an external source into well tubing to enhance lift of fluid in the tubing comprising:

a gas lift valve insertable in the tubing, said valve having a housing with an upper portion having at least one inlet port for admitting the gas from the external source into the valve, a lower portion having at least one outlet port for discharging the gas from the valve into the tubing and a mid-portion extending therebetween on a longitudinal axis;

an orifice mounted within said housing mid-portion, said orifice having a throat transverse to and symmetrical about said longitudinal axis, a nozzle extending upwardly from said throat and diverging symmetrically outwardly from said axis and a Venturi extending downwardly from said throat and diverging symmetrically outwardly from said axis, said orifice defining a path of flow of gas from said upper portion to said lower portion of said housing;

said nozzle including a nozzle first end, a nozzle second end, and a nozzle flow path between said nozzle first end and said nozzle second end, said nozzle flow path converging from said nozzle first end to said nozzle second end, such that the gas experiences a decrease in pressure;

said Venturi including a first end and a second end, and a Venturi flow path therebetween, said Venturi flow path diverging from said Venturi first end to said Venturi second end, such that the gas experiences a rise in pressure, said Venturi first end being disposed adjacent said nozzle second end, such that critical flow is achieved in said throat, said Venturi flow path being aligned with said nozzle flow path to provide a continuous flow path;

whereby said gas flows into said at least one inlet port of said housing through said continuous flow path, and out through said at least one outlet port into said tubing, and a check valve means responsive to said flow of gas.

2. The device of claim 1 wherein said nozzle has an upper end with a cross-section parallel to a cross-section of said throat, said nozzle upper end cross-section having an area approximately 2.5 times an area of said throat cross-section.

3. The device of claim 1 wherein said nozzle has an upper end with a cross-section parallel to a cross-section of said throat, said nozzle upper end cross-section having an area at least 2.5 times an area of said throat cross-section.

4. The device of claim 1 wherein said Venturi diverges from said axis at an angle of approximately 4 to 15 degrees.

5. The device of claim 1 wherein said Venturi diverges from said axis at an angle of approximately 6 degrees.

6. The device of claim 1 wherein said nozzle has a circular contour of equal radii greater than a diameter of said throat and having points of origin on a perimeter of a planar figure concentric about and in a plane common with said throat.

7. A device for controlling a flow of gas from an external source into well tubing to enhance lift of fluid in the tubing comprising:

a gas lift valve insertable in the tubing, said valve having a housing with an upper portion having at least one inlet port for admitting the gas from the external source into the valve, a lower portion having at least one outlet port for discharging the gas from the valve into the tubing and a mid-portion extending therebetween on a longitudinal axis;

an orifice mounted within said housing mid-portion, said orifice having a throat transverse to and symmetrical about said longitudinal axis, a nozzle extending upwardly from said throat and diverging symmetrically outwardly from said axis in a circular contour of equal radii greater than a diameter of said throat and having points of origin on a perimeter of a planar figure concentric about and in a plane common with said throat and a Venturi extending downwardly from said throat and diverging symmetrically linearly outwardly from said axis, said orifice defining a path of flow of gas from said upper portion to said lower portion of said housing;

said nozzle including a nozzle first end, a nozzle second end, and a nozzle flow path between said nozzle first end and said nozzle second end, said nozzle flow path converging from said nozzle first end to said nozzle second end, such that the gas experiences a decrease in pressure;

said Venturi including a first end and a second end, and a Venturi flow path therebetween, said Venturi flow path diverging from said Venturi first end to said Venturi second end, such that the gas experiences a rise in pressure, said Venturi first end being disposed adjacent said nozzle second end, said Venturi flow path being aligned with said nozzle flow path to provide a continuous flow path;

whereby said gas flows into said at least one inlet port of said housing through said continuous flow path, and out through said at least one outlet port into said tubing wherein a differential pressure between said nozzle first end and said Venturi second end is less than about 10%; and a check valve means responsive to said flow of gas.

8. The device of claim 7 wherein said nozzle radii is approximately 1.5 to 2.5 times said throat diameter.

9. The device of claim 7 wherein said nozzle radii is approximately 1.9 times said throat diameter.

10. The device of claim 7 wherein said Venturi has a conical contour.

11. A device for controlling a flow of gas from an external source into well tubing to enhance lift of production fluid in the tubing comprising:

a gas flow valve insertable in the tubing, said valve having an upper portion having at least one inlet port for admitting the gas from the external source into the valve, a lower portion having at least one outlet port for discharging the gas from the valve into the tubing and a mid-portion extending therebetween on a longitudinal axis; p1 an orifice mounted within said valve mid-portion, said orifice having a throat of circular cross-section taken in a direction transverse to said longitudinal axis, a nozzle extending upwardly from said throat and diverging symmetrically outwardly from said axis in a circular contour of equal radii greater than a diameter of said throat and having points of origin on a circle concentric about said axis and in a plane common with said throat cross-section and a Venturi extending downwardly from said throat and diverging symmetrically linearly outwardly from said axis, said orifice defining a path of flow of gas from said upper portion to said lower portion of said valve;

said nozzle including a nozzle first end, a nozzle second end, and a nozzle flow path between said nozzle first end and said nozzle second end, said nozzle flow path converging from said nozzle first end to said nozzle second end, such that the gas experiences a decrease in pressure;

said Venturi including a first end and a second end, and a Venturi flow path therebetween, said Venturi flow path diverging from said Venturi first end to said Venturi second end, such that the gas experiences a rise in pressure, said Venturi first end being disposed adjacent said nozzle second end, such that critical flow is achieved in said throat, said Venturi flow path being aligned with said nozzle flow path to provide a continuous flow path;

whereby said gas flows into said at least one inlet port of said valve through said continuous flow path, and out through said at least one outlet port into said tubing; and a check valve means responsive to said flow of gas.

12. The device of claim 11 wherein said nozzle has an upper end of circular cross-section parallel to said throat cross-section, said nozzle upper end cross-section having an area approximately 2.5 times an area of said throat cross-section.

13. The device of claim 11 wherein said nozzle has an upper end of circular cross-section parallel to said throat cross-section, said nozzle upper end cross-section having an area at least 2.5 times an area of said throat cross-section.

14. The device of claim 11 wherein said nozzle radii is approximately 1.5 to 2.5 times said throat diameter.

15. The device of claim 11 wherein said nozzle radii is approximately 1.9 times said throat diameter.

16. The device of claim 11 wherein said Venturi has a conical contour.

17. The device of claim 11 wherein said Venturi diverges from said axis at an angle of approximately 4 to 15 degrees.

18. The device of claim 11, wherein said Venturi diverges from said axis at an angle of approximately 6 degrees.

* * * * *